US011348717B2

(12) United States Patent
Joshi et al.

(10) Patent No.: US 11,348,717 B2
(45) Date of Patent: May 31, 2022

(54) THERMAL MANAGEMENT OF HIGH POWER INDUCTORS

(71) Applicant: Hamilton Sundstrand Corporation, Charlotte, NC (US)

(72) Inventors: Ashutosh Joshi, Roscoe, IL (US); Debabrata Pal, Hoffman Estates, IL (US); Mark W. Metzler, Davis, IL (US); Richard L. Downing, Loves Park, IL (US); Charles Patrick Shepard, DeKalb, IL (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 691 days.

(21) Appl. No.: 16/176,600

(22) Filed: Oct. 31, 2018

(65) Prior Publication Data

US 2020/0135378 A1 Apr. 30, 2020

(51) Int. Cl.

| | |
|---|---|
| ***H01F 27/10*** | (2006.01) |
| ***H01F 27/02*** | (2006.01) |
| ***H01F 27/12*** | (2006.01) |
| ***H01F 27/16*** | (2006.01) |
| ***H01F 27/28*** | (2006.01) |

(52) U.S. Cl.

CPC ..... *H01F 27/025* (2013.01); *H01F 27/12* (2013.01); *H01F 27/16* (2013.01); *H01F 27/2823* (2013.01)

(58) Field of Classification Search

CPC ..... H01F 27/025; H01F 27/12; H01F 27/16; H01F 27/2823; H01F 27/10; H01F 27/2895; H01F 37/00; H01F 27/2876; H01F 27/02

See application file for complete search history.

(56) References Cited

U.S. PATENT DOCUMENTS

| | | | | |
|---|---|---|---|---|
| 7,002,443 | B2 | 2/2006 | Ness et al. | |
| 8,125,777 | B1 | 2/2012 | Maclennan et al. | |
| 8,570,132 | B2 * | 10/2013 | Doo | H02M 7/003 336/90 |
| 9,299,488 | B2 | 3/2016 | Shepard et al. | |
| 9,373,436 | B2 * | 6/2016 | Pal | H01F 27/2876 |

(Continued)

FOREIGN PATENT DOCUMENTS

| | | | |
|---|---|---|---|
| DE | 102015203286 | A1 | 2/2015 |
| EP | 2858076 | A1 | 4/2015 |

(Continued)

OTHER PUBLICATIONS

Communication pursuant to 94(3) EPC; International Application No. 19206039.0-1212; International Filing Date: Oct. 29, 2019; dated Mar. 23, 2021; 9 pages.

(Continued)

*Primary Examiner* — Tuyen T Nguyen
(74) *Attorney, Agent, or Firm* — Cantor Colburn LLP

(57) ABSTRACT

An inductor assembly includes a housing including a base, a sidewall, and an insert. The base and the sidewall define a cavity and the insert being positioned within the cavity. A core assembly is positioned within the cavity. The core assembly includes a core and a plurality of windings wrapped about the core and disposed between the sidewall and the insert. A flow path is formed in the housing for receiving a coolant to remove heat from the core assembly.

14 Claims, 10 Drawing Sheets

(56) References Cited

U.S. PATENT DOCUMENTS

| | | | |
|---|---|---|---|
| 9,905,352 | B2 | 2/2018 | Cedell et al. |
| 2018/0096785 | A1 | 4/2018 | Hull et al. |
| 2018/0130590 | A1 | 5/2018 | Skalski et al. |

FOREIGN PATENT DOCUMENTS

| | | | |
|---|---|---|---|
| EP | 2966659 | A2 | 1/2016 |
| EP | 2966660 | A1 | 1/2016 |

OTHER PUBLICATIONS

Extended European Search Report; International Application No. 19206039.0-1212; International Filing Date: Oct. 29, 2019; dated Mar. 19, 2020; 12 pages.

* cited by examiner

THERMAL MANAGEMENT OF HIGH POWER INDUCTORS

BACKGROUND

Embodiments of the present disclosure relate to an inductor assembly, and more particularly, to liquid cooling of an inductor assembly such as used in aerospace applications.

Current flowing through inductor assemblies generally produces heat. In some types of inductor assemblies, the heat generated by current traversing the conductive wires is sufficient to limit the current carrying capability, e.g. the current rating, of the inductor assembly. It can also influence core size, core material selection, and/or the reliability of the filtering functionality provided by the core. Conventional inductor assemblies therefore typically have a maximum core temperature limit and corresponding current limit.

Such conventional methods and systems have generally been considered satisfactory for their intended purpose. However, there is still a need in the art for improved inductor assemblies that allows for improved current carrying capability.

BRIEF DESCRIPTION

According to an embodiment, an inductor assembly includes a housing including a base, a sidewall, and an insert. The base and the sidewall define a cavity and the insert being positioned within the cavity. A core assembly is positioned within the cavity. The core assembly includes a core and a plurality of windings wrapped about the core and disposed between the sidewall and the insert. A flow path is formed in the housing for receiving a coolant to remove heat from the core assembly.

In addition to one or more of the features described above, or as an alternative, in further embodiments the flow path includes at least one first channel, the at least one first channel extending within a plane defined by the base.

In addition to one or more of the features described above, or as an alternative, in further embodiments the at least one first channel is aligned with one of the plurality of windings.

In addition to one or more of the features described above, or as an alternative, in further embodiments the at least one first channel has an arcuate contour.

In addition to one or more of the features described above, or as an alternative, in further embodiments a radius of the at least is equal to an outer diameter of the core.

In addition to one or more of the features described above, or as an alternative, in further embodiments a portion of the at least one first channel extends at an angle to the base.

In addition to one or more of the features described above, or as an alternative, in further embodiments the portion of the at least one first channel is formed in the sidewall.

In addition to one or more of the features described above, or as an alternative, in further embodiments the flow path includes at least one second channel arranged in fluid communication with the at least one first channel, wherein a portion of the at least one second channel extending at an angle into the base.

In addition to one or more of the features described above, or as an alternative, in further embodiments the at least one second channel is formed in the insert.

In addition to one or more of the features described above, or as an alternative, in further embodiments the at least one second channel includes an angular section having an apex opposite the base.

In addition to one or more of the features described above, or as an alternative, in further embodiments the at least one second channel includes a plurality of angular sections arranged in series.

In addition to one or more of the features described above, or as an alternative, in further embodiments the at least one second channel includes a plurality of vertical sections fluidly coupled by a plurality of planar sections.

In addition to one or more of the features described above, or as an alternative, in further embodiments comprising a base cover affixed to the base of the housing.

In addition to one or more of the features described above, or as an alternative, in further embodiments the housing of the inductor assembly further comprises another sidewall and another insert, the base and the another sidewall defined another cavity, the another insert being positioned within the another cavity, another core assembly being receivable within the another cavity.

In addition to one or more of the features described above, or as an alternative, in further embodiments the flow path includes a first flow path for removing heat from the core positioned within cavity and a second flow path for removing heat from the core positioned within the another cavity.

In addition to one or more of the features described above, or as an alternative, in further embodiments the flow path further comprises an inlet and an outlet, both the first flow path and the second flow path being arranged in fluid communication with the inlet and the outlet.

In addition to one or more of the features described above, or as an alternative, in further embodiments the first flow path and the second flow path are symmetrical.

In addition to one or more of the features described above, or as an alternative, in further embodiments flow path additionally includes a bypass flow path arranged in parallel with the first flow path and the second flow path.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
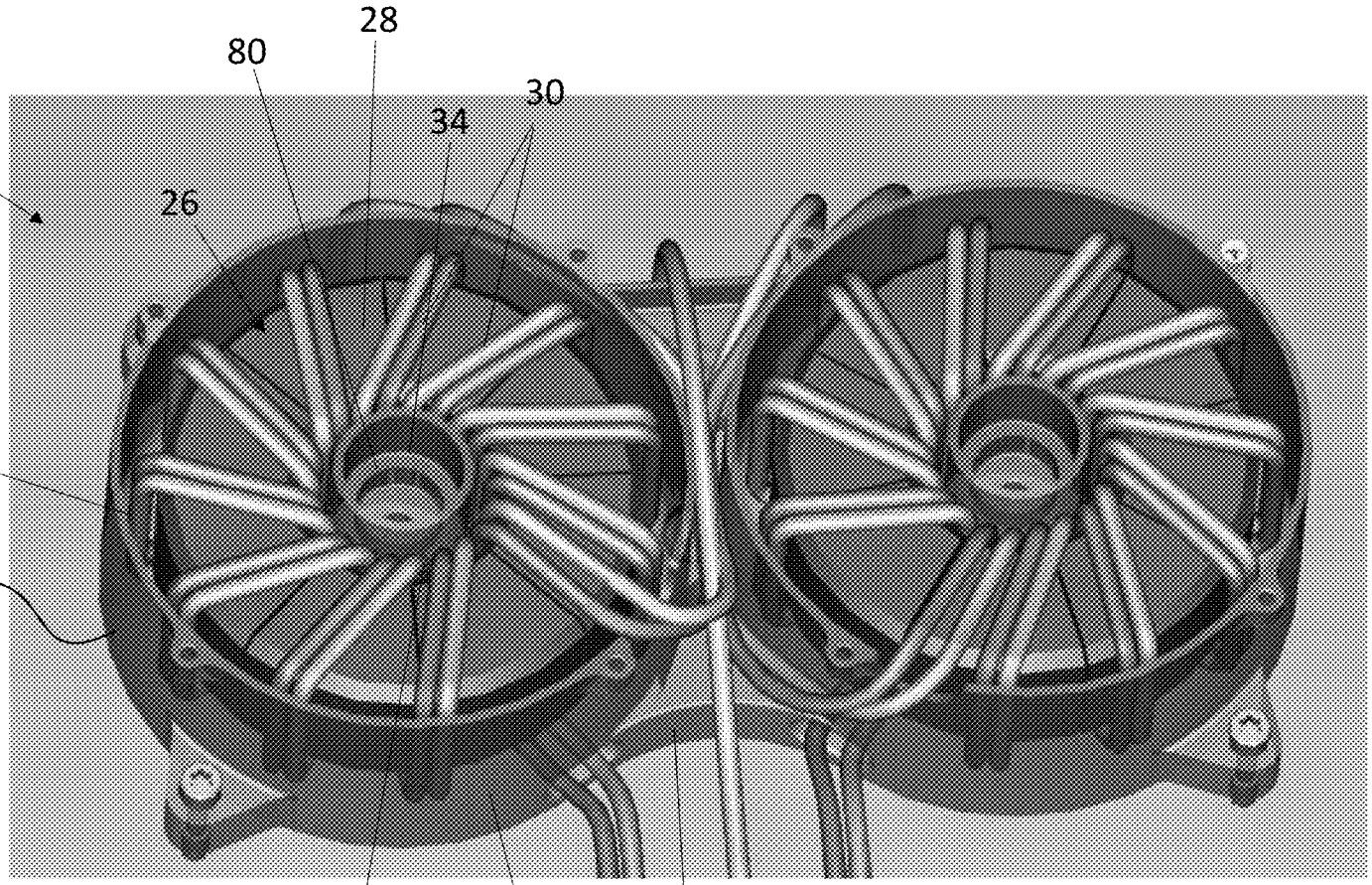
FIG. 1 is a perspective view of an inductor assembly according to an embodiment.
Figure 2:
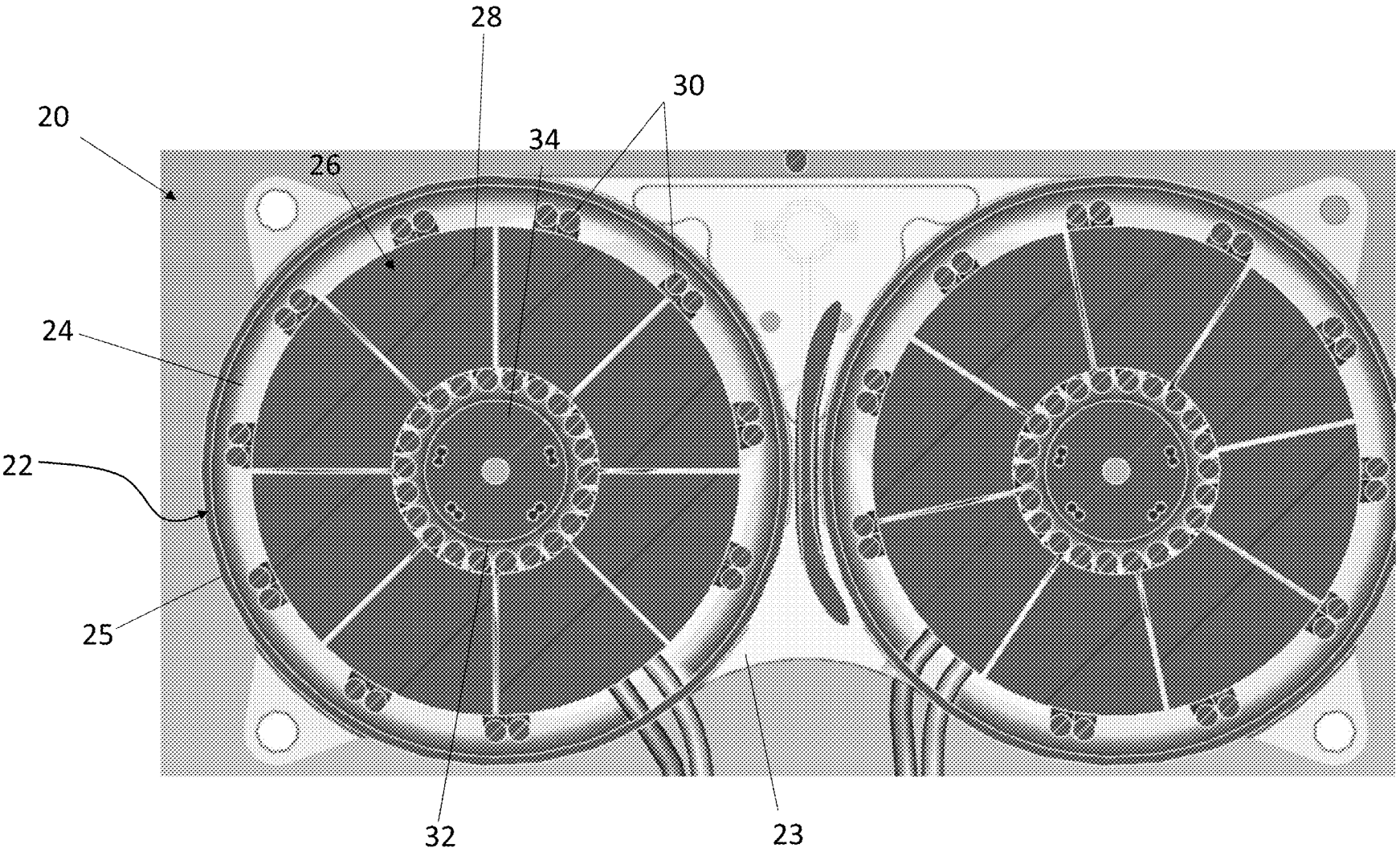
FIG. 2 is a cross-sectional view of the inductor assembly of FIG. 1 taken through a central plane according to an embodiment.
Figure 3:
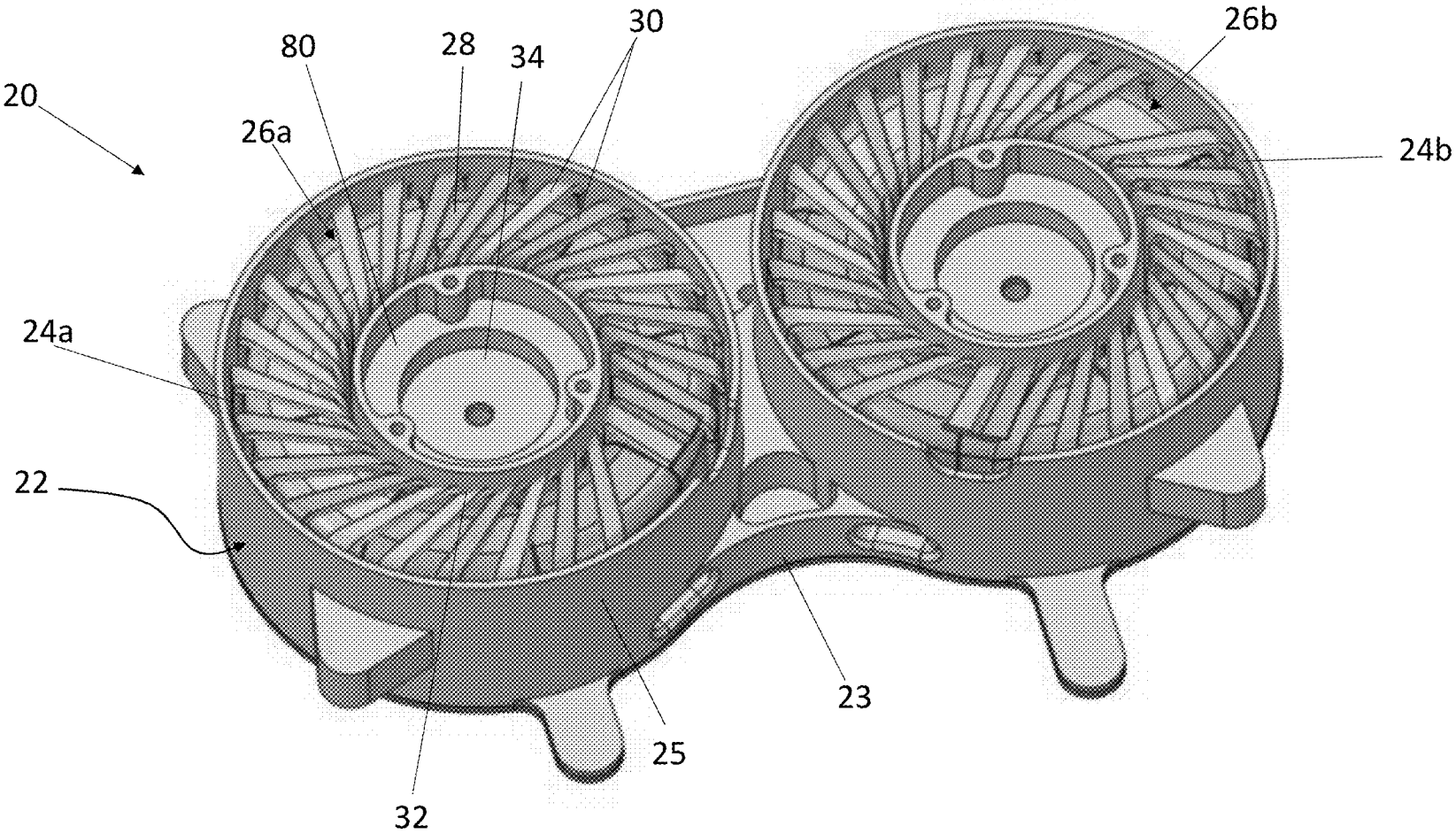
FIG. 3 is a perspective view of another inductor assembly according to an embodiment.

With reference to FIGS. 1-3, an example of an inductor assembly 20 is shown. The inductor assembly 20 includes a housing 22 having a base 23 and an integral sidewall 25 extending, such as perpendicularly for example, from the base 23. The base 23 and sidewall 25 of the housing 22 cooperate to define a cavity 24 of the housing 22 within which a core assembly 26 is received. The core assembly 26 includes a core 28 and a plurality of windings 30 wrapped about the core 28. Each core 28 includes a central opening 32 and an insert 34 of the housing 22 seats within the central opening 32 to restrict movement of the core 28 relative to the housing 22. The insert 34 is in thermal communication with the core 28 and the windings 30 wrapped about the core 28. In an embodiment, the remaining inner volume of the cavity 24 is filled with a thermally conductive potting material. This potting material facilitates conduction of heat from the core assembly 26, such as to the base 23 and the insert 34 of the housing 22 for example. In an embodiment, a cover 36 is disposed within the cavity 24 in overlapping arrangement with the core assembly 26. As shown, the cover 36 includes a plurality of openings 38 through which a portion of the heat generated by the core assembly 26 is dissipated.

In the non-limiting embodiment of FIG. 1, groups of windings 30 are spaced about the outer periphery of the core 28. Another example of a configuration of the windings 30 is shown in FIG. 3. In the embodiment, individual windings 30 are equidistantly spaced about the core 28. However, it should be understood that any suitable configuration of the windings 30 is contemplated herein. In each of the embodiments, the, the heat flux at the inner diameter of the core 28 is greater than at the outer diameter of the core 28.

In an embodiment, the housing 22 may be designed to support a plurality of core assemblies 26. For example, in the illustrated, non-limiting embodiments, the inductor assembly 20 includes a first core assembly 26*a* arranged within a first cavity 24*a* and a second core 26*b* assembly arranged within a second cavity 24*b*. The first and second core assembly 26*a*, 26*b* may be substantially identical, or alternatively, may have varying configurations. Although two core assemblies 26*a*, 26*b* are illustrated, it should be understood that embodiments including a single core assembly, or alternatively, more than two core assemblies are within the scope of the disclosure.

Figure 4:
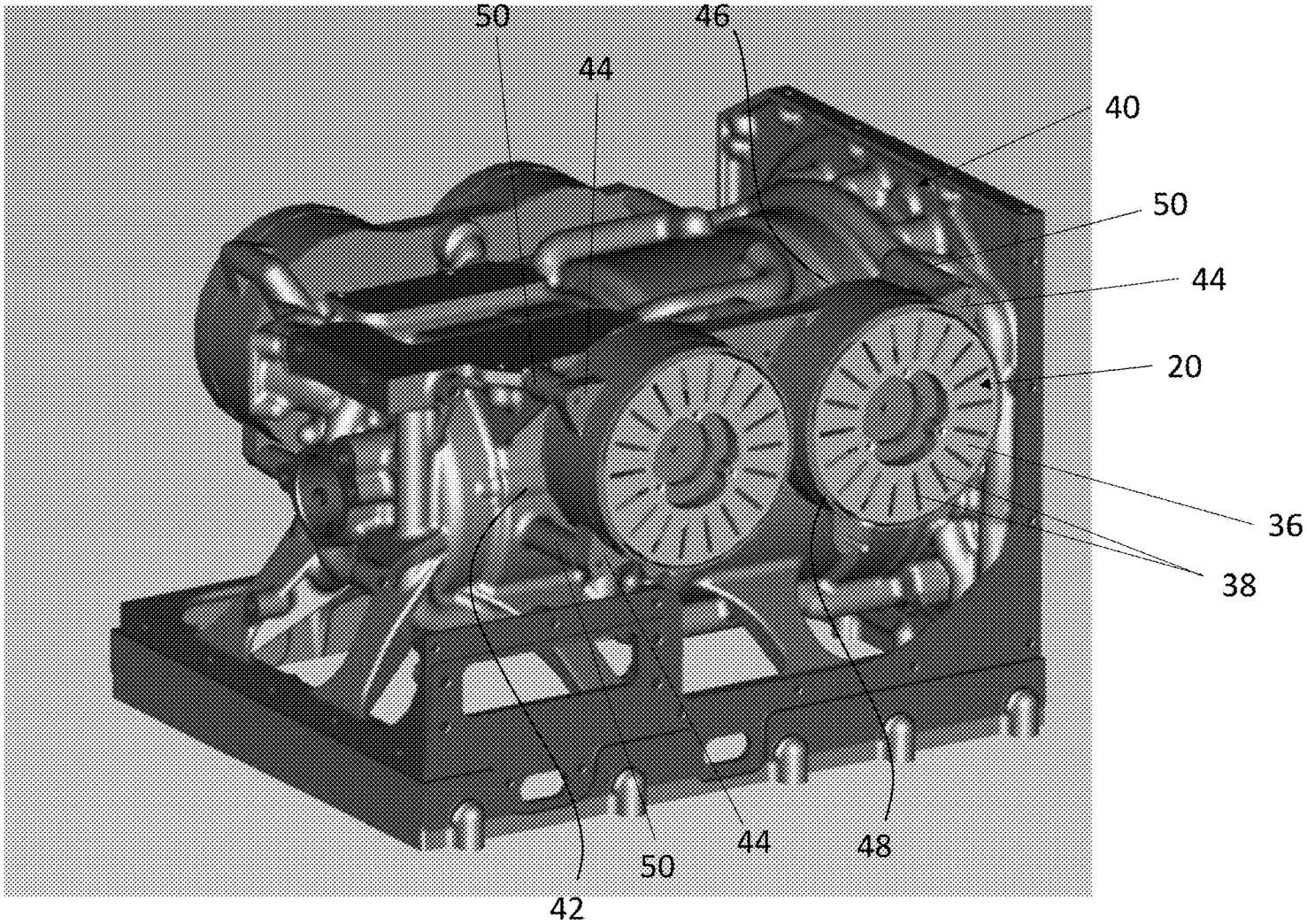
FIG. 4 is a perspective view of an inductor assembly mounted to a generator housing according to an embodiment.

With reference now to FIG. 4, the inductor assembly 20 is shown mounted adjacent an exterior surface 42 of a generator housing 40. In such embodiments, the generator housing 40 may be mounted to a portion of a gas turbine engine of an aircraft, such as an accessories mounting and drive assemblies (AMAD) for example. As shown, a plurality of connector flanges 44 extend outwardly from various locations about a periphery of the housing 22. In the illustrated, non-limiting embodiment, the connector flanges 44 are arranged centrally between the first end 46 of the housing 22 and a second, opposite end 48 of the housing 22. The first end 46 faces toward the generator housing 40, and the second end 48 faces outward from the generator housing 40. When the inductor housing 22 is positioned relative to the generator housing 40, each of the plurality of connector flanges 44 is aligned with and affixed to a corresponding standoff 50 extending from the generator housing 40. An axial length of each of the standoffs 50 is greater than the distance between the first end 46 of the inductor housing 22 and a connector flange 44 such that when the inductor assembly 20 is mounted to the generator housing 40, the first end 46 of the inductor assembly 20 is offset therefrom. As a result, thermal coupling between the inductor assembly 20 and the generator housing 40 is limited to the interface between the connector flanges 44 and standoffs 50.

A flow of coolant, such as oil or glycol water for example, is used to cool the one or more core assemblies 26 of the inductor assembly 20.

With reference now to FIGS. 5-10, a flow path 60 through which coolant flows to remove heat from the core assembly 26 of the inductor assembly 20 is formed in the housing 22. In an embodiment, the flow path 60 is machined into the inductor housing 22. In another embodiment, the flow path 60 may be formed simultaneously with the housing 22, such as via an additive manufacturing process for example. A cover (not shown) is affixed to the base 23 of the inductor housing 22, such as via brazing for example, to restrict the flow of coolant to within the flow path 60.

The flow path 60 formed in the housing 22 typically includes an inlet 62 and an outlet 64 disposed adjacent opposite sides of the housing 22. In embodiments where the housing 22 includes a first cavity 24*a* and a second cavity 24*b*, and is therefore configured to receive a first core assembly 26*a* and a second core assembly 26*b*, the inlet 62 and outlet 64 may be positioned centrally between the sidewalls 25 associated with the first and second core assemblies 26*a*, 26*b*. In such embodiments, the flow path 60 may include a first flow path 66 for cooling the first core assembly 26*a* and a second flow path 68 for cooling the second core assembly 26*b*. However, it should be understood that embodiments including a single flow path for cooling multiple core assemblies are also within the scope of the disclosure. In an embodiment, the first and second flow paths 66, 68 are symmetrical about an axis A, extending between the inlet 62 and the outlet 64. The flow path 60 may additionally include a bypass flow path 70 directly coupling the inlet 62 and the outlet 64 and arranged at the central portion of the housing 22, between the core assemblies 26*a*, 26*b*.

For ease of understanding, only the first flow path 66 of each of the various coolant flow path configurations illustrated herein will be described. Each configuration of the first flow path 66 includes at least one first channel formed in the surface of the base 23 defining the first end 46 of the housing 22. The first flow path 66 additionally includes at least one second channel 74 formed over the height of the insert 34. As a result, the coolant provided to first flow path 66 of the housing 22 cools not only the portion of the housing 22 adjacent a first end surface (not shown) of the core assembly 26, but also cools the insert 34 arranged in thermal communication with the inner diameter of the core assembly 26.

Heat is configured to conduct from the core assembly 26, through a potting material, to the flow path 60 formed in the housing 22. In operation, a coolant is provided from the inlet 62 to the first flow path 66. As the coolant moves through the first flow path 66, the coolant not only absorbs heat conducted to the housing 22 from the adjacent core assembly 26, but also absorbs heat via convection between the housing 22 and the coolant. The heated coolant is then provided to the outlet 64 where the heat may be removed from the coolant by a liquid or air cooled heat exchanger before returning the coolant to the inlet 62.

Figure 5:
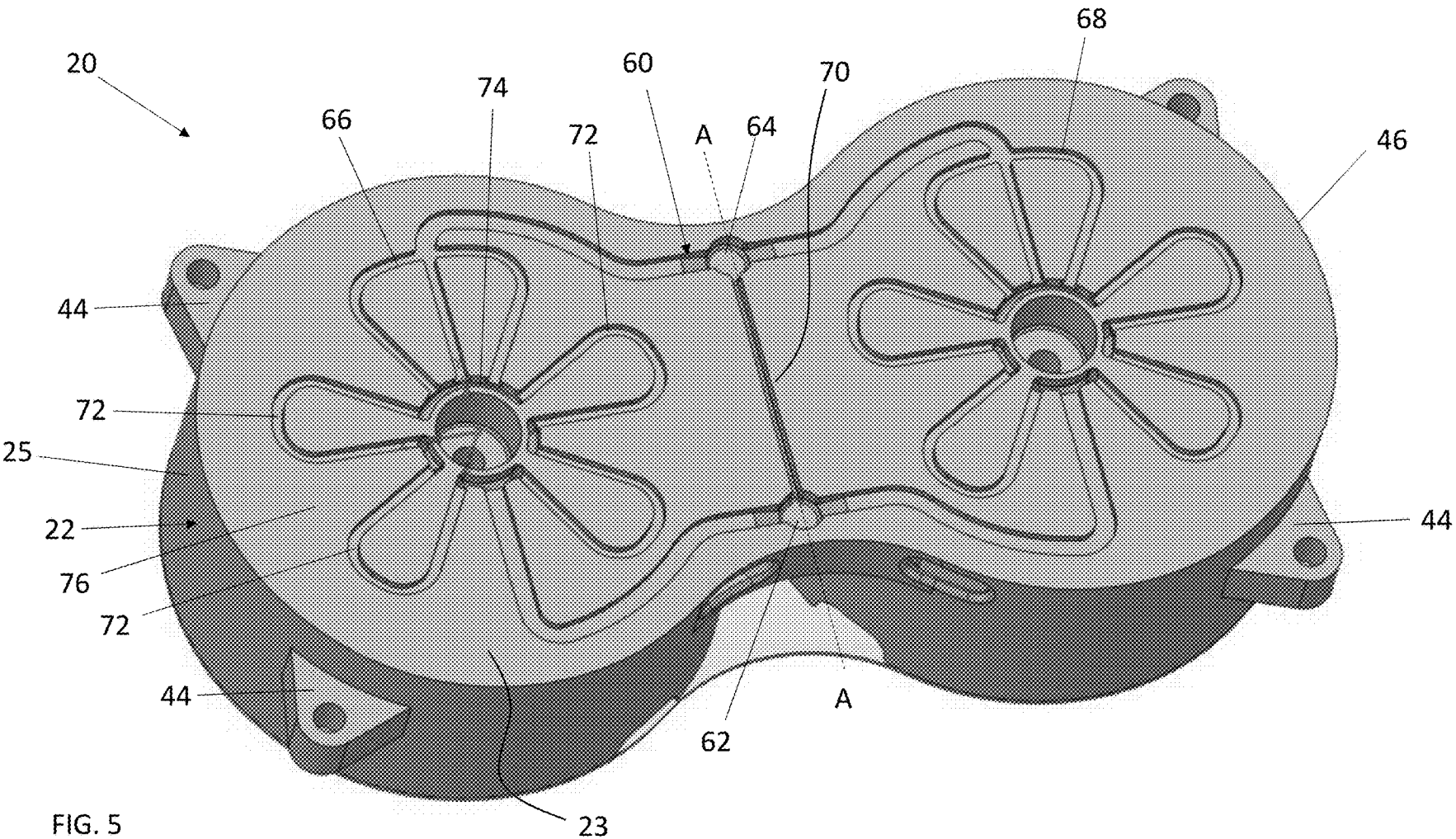
FIG. 5 is a perspective view of a back surface of a housing of an inductor assembly according to an embodiment.
Figure 6:
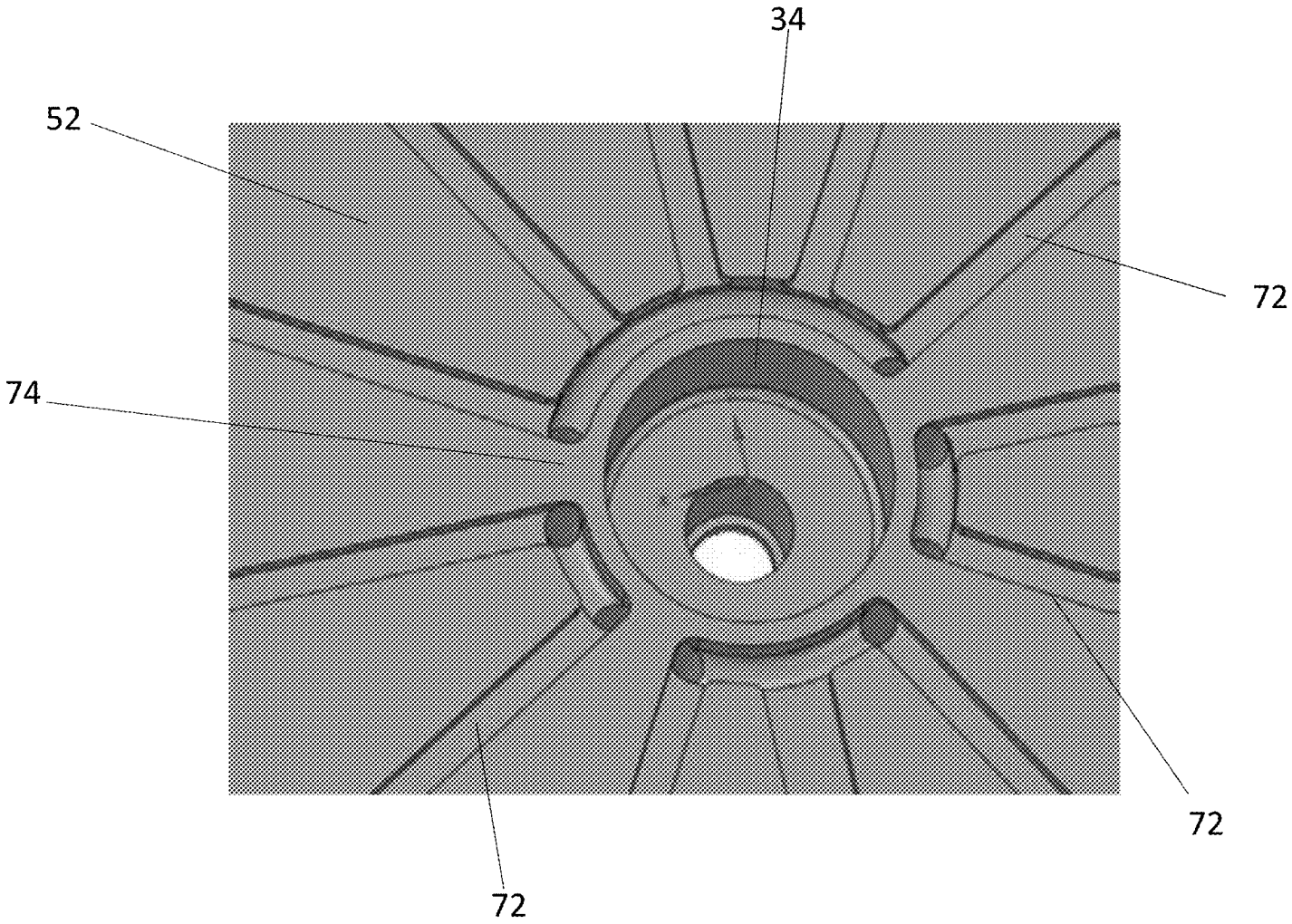
FIG. 6 is a detailed view of the identified portion of FIG. 5 according to an embodiment.
Figure 7:
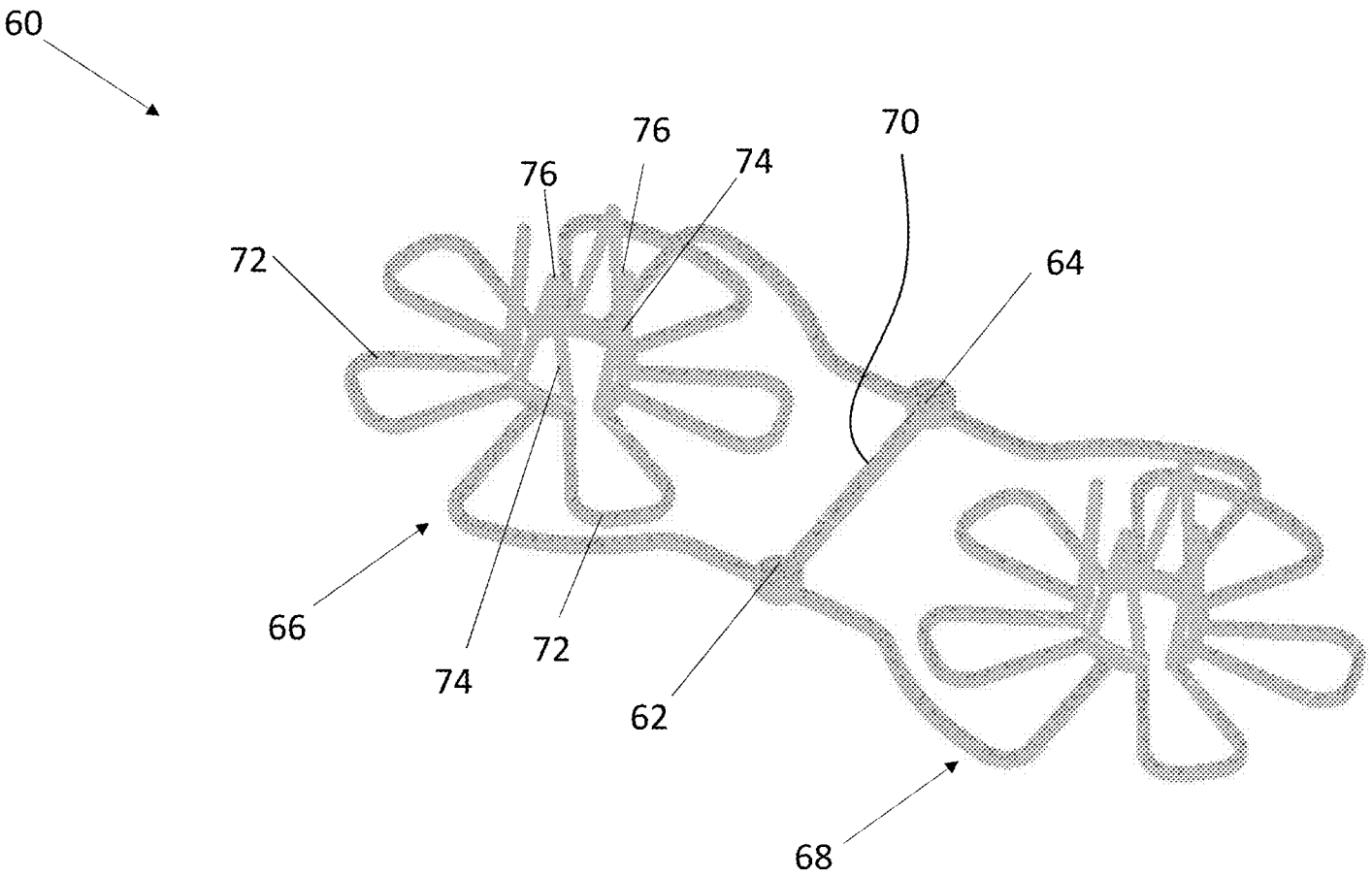
FIG. 7 is a perspective view of the coolant flow path formed in the inductor housing according to an embodiment.

In the non-limiting embodiment illustrated in FIGS. 5-7, the first flow path 66 includes at least one first channel 72 having a non-linear configuration. As shown, the at least one first channel 72 includes a serpentine configuration extending between an interior portion of the base 23, arranged generally adjacent the insert 34 and an inner diameter of the first core assembly 26*a*, and outer portion of the base 23, located generally adjacent the outer diameter of the first core assembly 26. The configuration of the at least one first channel 72 may align with each of the plurality of windings 30 of the core assembly 26*a*.

The first flow path 66 additionally includes at least one second channel 74 (best shown in FIG. 7) in fluid communication with the first channel 72. In the illustrated, non-limiting embodiment, the first flow path 66 includes a plurality of second channels 74, separated from one another and spaced about the periphery of the insert 34. The plurality of second channels 74 extend through the insert 34 of the housing 22, for example, in a direction generally perpendicular to the base 23 and the first channel 72. In the illustrated, non-limiting embodiment, the second channels 74 have a generally triangular configuration such that the portion of each second channel 74 positioned furthest from the base 23 includes an apex 76. Because the heat flux of the first core assembly 26*a* is greatest adjacent the inner diameter thereof, inclusion of these second channels 74, which extend through the insert 34 over at least a portion of the height of the first core assembly 26*a*, substantially cools the inner diameter of the first core assembly 26*a*.

In the illustrated, non-limiting embodiment, the first flow path 66 is divided into two parallel and substantially identical and/or symmetrical portions such that each portion removes heat from a corresponding portion of the first core assembly 26*a*. Accordingly, as shown, each of these portions of the first flow path 66 includes both first and second channels 72, 74. However, it should be understood that embodiments where the first flow path 66 includes only a single path configured to cool the first core assembly 26*a* are also within the scope of the disclosure.

Figure 8:
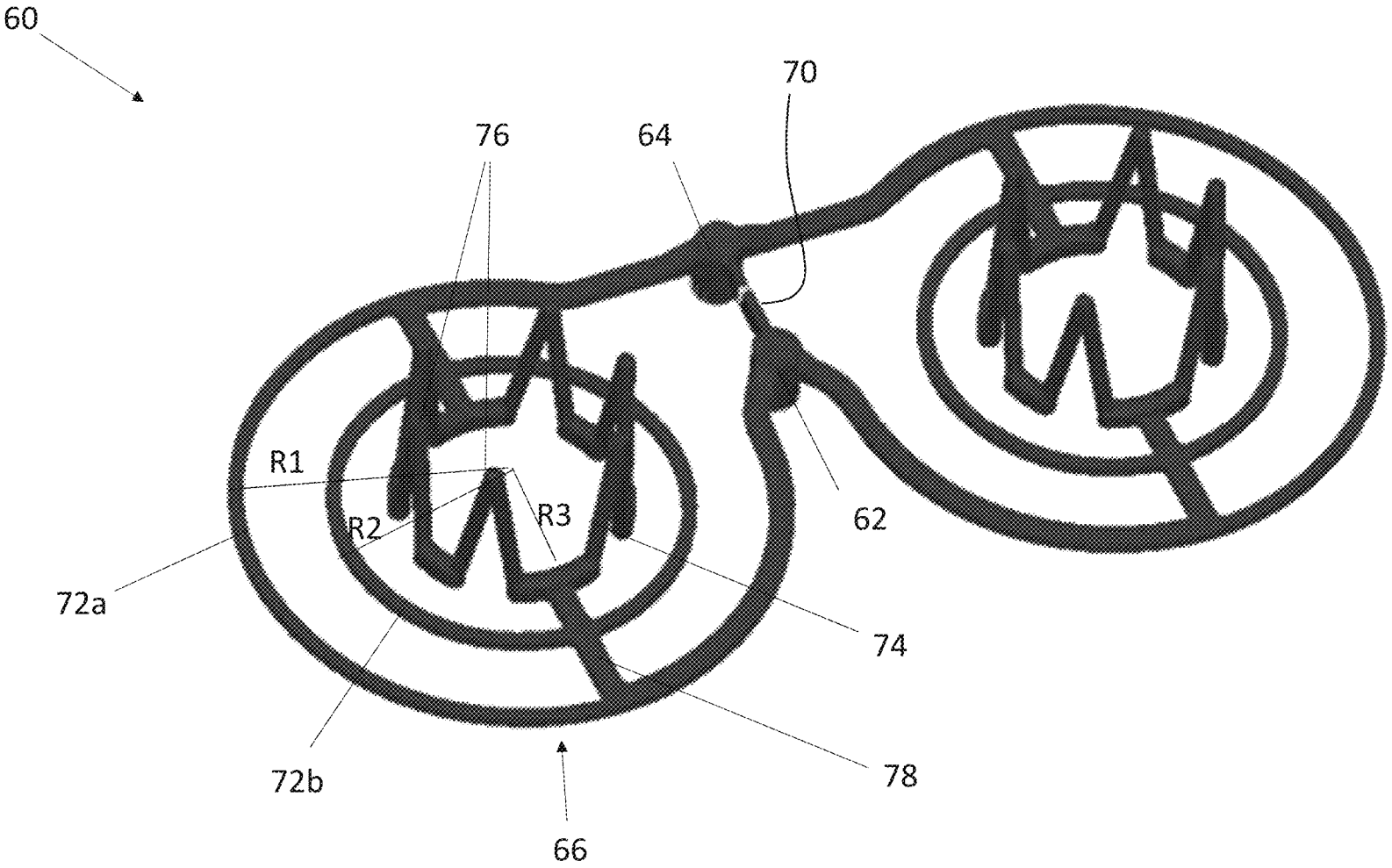
FIG. 8 is a perspective view of the coolant flow path formed in the inductor housing according to another embodiment.
Figure 9:
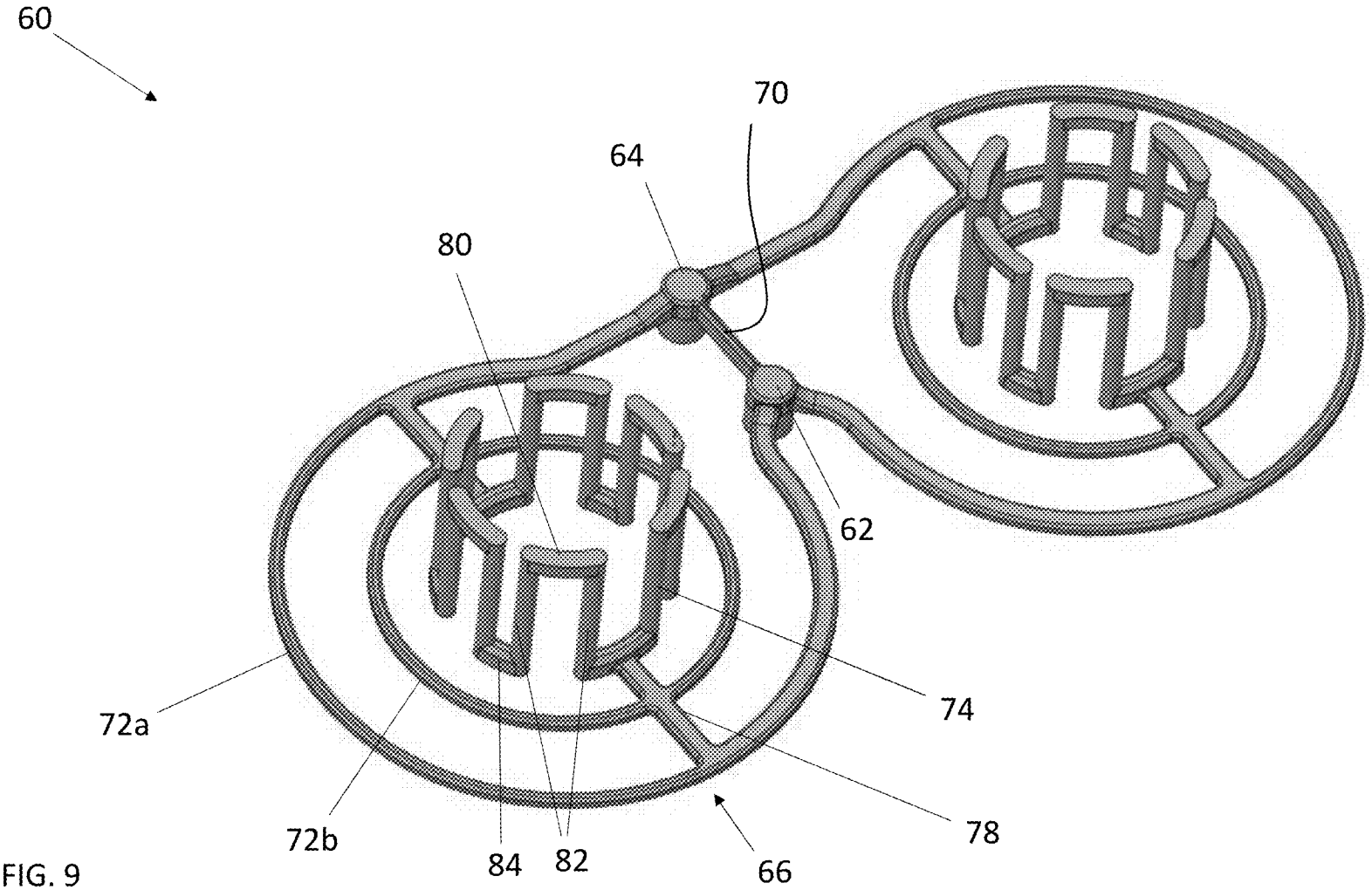
FIG. 9 is a perspective view of the coolant flow path formed in the inductor housing according to another embodiment.
Figure 10:
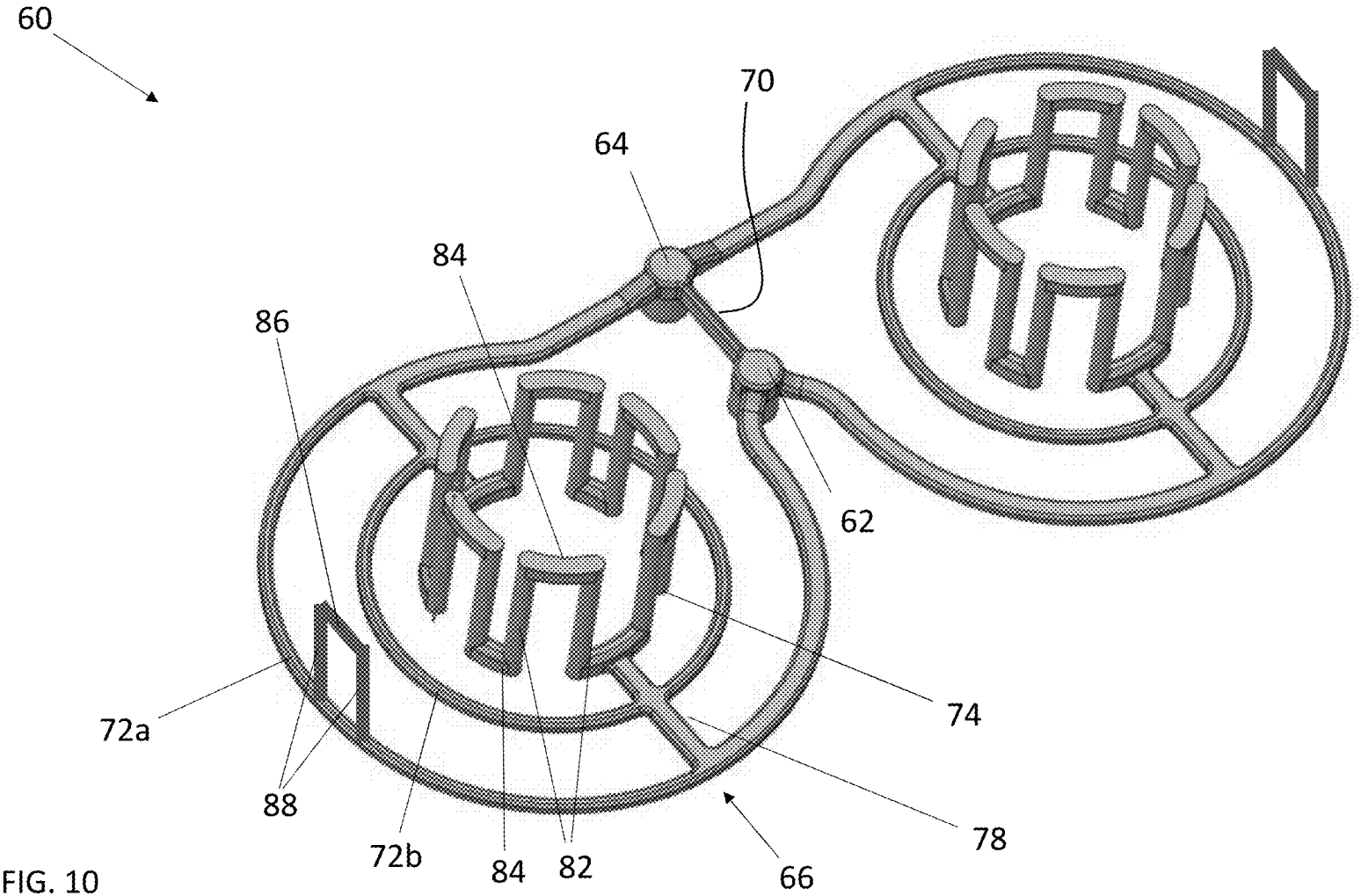
FIG. 10 is a perspective view of the coolant flow path formed in the inductor housing according to another embodiment.

With reference now to FIGS. 8-10, in another embodiment, the first flow path 66 includes a plurality of concentric first channels 72 arranged in fluid communication. In the illustrated, non-limiting embodiment, the first channels 72 are generally arcuate in shape such that a first channel 72*a* is generally defined by a first radius, and another first channel 72*b* is generally defined by a second radius. The second radius is smaller than the first radius. In an embodiment, the radius of the first channel 72*a* is generally equal to an outer radius of a core assembly 26.

The first flow path 66 additionally includes at least one second channel 74 arranged generally concentrically with the first channels 72. The at least one second channel 74 has a third radius, smaller than the second radius. In an embodiment, the radius of at least one the second channel 74 is generally equal to a radius of the insert 34, such that the second channel 74 is formed within the insert 34. In an embodiment, the first channel 72*a*, another first channel 72*b*, and second channel 74 are arranged in parallel with respect to the flow of coolant, via an axially extending connector 78.

As previously described, in each of the embodiments illustrated in FIGS. 8-10, the second channel 74 is formed in a portion of the insert 34. The second channel 74 is configured to extend both peripherally and vertically through the insert 34. Accordingly, as shown, flow of coolant within the second channel 74 of the first flow path 66 is configured to repeatedly move between a first plane, aligned with the base 23, and a second parallel plane offset from the first plane. In an embodiment, the second plane is defined by an upper surface 80 of the insert 34, or alternatively, at any location between the upper surface 80 of the insert 34 and the base 23.

In the illustrated, non-limiting embodiment of FIG. 8, the portion of the first flow path 66 defined by the second channel 74 includes a plurality of angular sections arranged in series. Similar to the embodiment of FIG. 7, each angular section is triangular in shape and includes an apex 76 disposed at the furthest portion of the second channel 74 relative to the base 23. In another embodiment, illustrated in FIG. 9, the portion of the first flow path 66 defined by the second channel 74 is configured to move arcuately within both the first plane and the second plane. As shown, a planar section 84 extends between adjacent parallel, vertical sections 82 of the second channel 74. The location of each planar section 84 varies sequentially between the first plane defined by the base 23 and the second plane, such as defined by the upper surface 80 of the insert 34 for example.

In an embodiment, best shown in FIG. 10, one of the first channels 72 of the flow path 66, such as channel 72*a* for example, is configured to extend both peripherally and vertically through the sidewall 25 of the housing 22. For example, the portion of the first flow path 66 defined by the first channel 72 may be configured to move arcuately within both the first plane defined by the base 23 and a second, parallel plane. In an embodiment, the second parallel plane may be located at any position over the height of the sidewall 25. As shown in FIG. 10, a planar section 86 extends between adjacent vertical sections 88 formed in the first channel 72. Although the first channel 72 is shown as having a specific configuration, it should be understood that embodiments having any flow configuration extending both peripherally and vertically through the sidewall 25 are within the scope of the disclosure. Further, it should be understood that any configured of the flow path formed in the base of the housing 22 and extending at least partially over the height of the insert 34 of the housing 22 is within the scope of the disclosure.

The overall configuration of the flow path 60 may be customized to maximize the heat transfer between the coolant and the hot spots of the core assembly 26, thereby reducing the temperature of the core 28 and windings 30 to below their respective material ratings. Further, by integrating the coolant flow into the housing 22 of the inductor assembly 20, the need for additional components, and therefore the overall size of the assembly 20 may be reduced. Each of the non-limiting embodiments illustrated herein includes a plurality of narrow flow channels to ensure the light weight of the housing 22 and inductor assembly 20, as well as a reduced pressure drop in the inductor assembly 20, which is critical for aerospace applications.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An inductor assembly comprising:

a housing including a base, a sidewall, and an insert, wherein the base and the sidewall define a cavity, the insert being positioned within the cavity;

a core assembly within the cavity, wherein the core assembly includes a core and a plurality of windings wrapped about the core and disposed between the sidewall and the insert; and a flow path formed in the housing for receiving a coolant to remove heat from the core assembly, the flow path including at least one first channel extending within a plane of the base and at least one second channel fluidly coupled with the at least one first channel, wherein a portion of the at least one second channel extends at an angle to the base, the at least one second channel including a plurality of angular sections arranged in series, and adjacent angular sections having an apex opposite the base.

2. The inductor assembly of claim 1, wherein the at least one first channel is aligned with one of the plurality of windings.

3. The inductor assembly of claim 1, wherein the at least one first channel has an arcuate contour.

4. The inductor assembly of claim 1, wherein a radius of the at least one first channel is equal to an outer diameter of the core.

5. The inductor assembly of claim 1, wherein a portion of the at least one first channel extends out of the plane of the base.

6. The inductor assembly of claim 5, wherein the portion of the at least one first channel is formed in the sidewall.

7. The inductor assembly of claim 1, wherein the at least one second channel is formed in the insert.

8. The inductor assembly of claim 1, further comprising a base cover affixed to the base of the housing.

9. The inductor assembly of claim 1, wherein the housing of the inductor assembly further comprises another sidewall and another insert, the base and the another sidewall defined another cavity, the another insert being positioned within the another cavity, another core assembly being receivable within the another cavity.

10. The inductor assembly of claim 9, wherein the flow path includes a first flow path for removing heat from the core positioned within cavity and a second flow path for removing heat from the core positioned within the another cavity.

11. The inductor assembly of claim 10, wherein the flow path further comprises an inlet and an outlet, both the first flow path and the second flow path being arranged in fluid communication with the inlet and the outlet.

12. The inductor assembly of claim 10, wherein the first flow path and the second flow path are symmetrical.

13. The inductor assembly of claim 10, wherein flow path additionally includes a bypass flow path arranged in parallel with both the first flow path and the second flow path.

14. An inductor assembly comprising:

a housing including a base, a sidewall, an insert, another sidewall, and another insert, wherein the base and the sidewall define a cavity and the insert is positioned within the cavity and the base and the another sidewall defined another cavity, the another insert being positioned within the another cavity;

a core assembly within the cavity and another core assembly arranged within the another cavity, wherein the core assembly includes a core and a plurality of windings wrapped about the core and disposed between the sidewall and the insert; and a flow path formed in the housing for receiving a coolant to remove heat from the core assembly, the flow path including a first flow path for removing heat from the core positioned within cavity and a second flow path for removing heat from the another core positioned within the another cavity, and a bypass flow path arranged in parallel with the first flow path and the second flow path.

* * * * *